US011476024B2

(12) United States Patent
Fujito et al.

(10) Patent No.: US 11,476,024 B2
(45) Date of Patent: Oct. 18, 2022

(54) INSULATED ELECTRIC WIRE, COIL AND PRODUCING METHOD FOR SAME COIL

(71) Applicant: Hitachi Metals, Ltd., Tokyo (JP)

(72) Inventors: Keisuke Fujito, Tokyo (JP); Shohei Hata, Tokyo (JP); Hiromitsu Kuroda, Tokyo (JP); Takayuki Tuji, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 322 days.

(21) Appl. No.: 16/874,231

(22) Filed: May 14, 2020

(65) Prior Publication Data

US 2020/0373049 A1 Nov. 26, 2020

(30) Foreign Application Priority Data

May 20, 2019 (JP) ..... JP2019-094290

(51) Int. Cl.

| | |
|---|---|
| ***H01B 1/02*** | (2006.01) |
| ***H01F 5/06*** | (2006.01) |
| ***H01F 41/04*** | (2006.01) |
| ***H01B 3/30*** | (2006.01) |

(52) U.S. Cl.

CPC ..... *H01F 5/06* (2013.01); *H01B 1/02* (2013.01); *H01B 3/305* (2013.01); *H01B 3/306* (2013.01); *H01F 41/04* (2013.01)

(58) Field of Classification Search

CPC . H01B 1/02; H01B 1/04; H01B 3/304; H01B 3/305; H01B 7/02; H01B 7/04; H01B 7/06; H01B 7/08

USPC ..... 174/36, 110 R–110 PM

See application file for complete search history.

(56) References Cited

U.S. PATENT DOCUMENTS

| | | | | |
|---|---|---|---|---|
| 11,094,434 | B2 * | 8/2021 | Kuroda | H01B 1/08 |
| 2012/0048592 | A1 * | 3/2012 | Kikuchi | H01B 3/306 524/602 |

FOREIGN PATENT DOCUMENTS

| | | | |
|---|---|---|---|
| JP | 2012-87360 | A | 0/5201 |
| JP | 2002-203438 | A | 7/2002 |
| JP | 2018-032596 | A | 3/2018 |
| JP | 2018-40042 | A | 3/2018 |

OTHER PUBLICATIONS

Official Action dated Sep. 6, 2022 received from the Japanese Patent Office in related JP 2019-094290 together with English language translation.

* cited by examiner

*Primary Examiner* — William H. Mayo, III

(74) *Attorney, Agent, or Firm* — Scully, Scott, Murphy & Presser, PC

(57) ABSTRACT

An insulated electric wire is composed of a conductor composed of a copper material, and an electrical insulating layer provided on an outer periphery of the conductor. For the constituent conductor of the insulated electric wire, in an orientation intensity ratio obtained by X-ray diffraction of a transverse cross section of the conductor, an intensity in a [200] crystal orientation is higher than an intensity in a [111] crystal orientation.

5 Claims, 4 Drawing Sheets

INSULATED ELECTRIC WIRE, COIL AND PRODUCING METHOD FOR SAME COIL

CROSS-REFERENCE TO RELATED APPLICATIONS

The present invention is based on Japanese Patent Application No. 2019-094290 filed on May 20, 2019, the entire contents of which are incorporated herein by reference.

BACKGROUND OF THE INVENTION

1. Field of the Invention

The present invention relates to an insulated electric wire, a coil and a producing method for the same coil.

2. Description of the Related Art

Electric devices such as rotating electric machines (motors), transformers or the like are equipped with a built-in coil. The coil is molded by using an insulated electric wire with an electrical insulating layer provided on an outer periphery of a conductor therein. The insulated electric wire is produced by faulting the electrical insulating layer on the outer periphery of the conductor by a method, which dissolves a resin component in an organic solvent to produce an electrical insulating coating, followed by applying that produced electrical insulating coating to the outer periphery of the conductor, and subsequent baking, or by a method, which extrudes a molten resin to the outer periphery of the conductor, or by using these methods in combination.

In molding the insulated electric wire into the coil, the insulated electric wire is subjected to various workings such as an edgewise bend working, a torsion working and the like (see, e.g., JP-A-2002-203438 and JP-A-2018-032596).

[Patent Document 1] JP-A-2002-203438

[Patent Document 2] JP-A-2018-032596

SUMMARY OF THE INVENTION

In molding the coil by using the insulated electric wire, the insulated electric wire is molded into the coil by being subjected to a predetermined working such as a bend working or a torsion working or the like. At this point of time, a working strain is caused in the constituent conductor of that insulated electric wire by the working such as a bend working or a torsion working or the like. Since that conductor with the working strain caused therein is increased in resistance value, the coil molded by using the worked insulated electric wire is degraded in electrical properties. For that reason, it is desirable to subject the worked insulated electric wire to a heating treatment, and thereby reduce the increased resistance value of the conductor to on the order of the resistance value of the conductor of the unworked insulated electric wire.

Conventionally, the increased resistance value of the constituent conductor of the insulated electric wire resulting from the above workings is decreased by heating that insulated electric wire to such an extent (e.g., to such a temperature higher than 200 degrees C.) as to recrystallize a copper material (e.g., a copper wire made of an oxygen-free copper) constituting the constituent conductor of that insulated electric wire. However, when the insulated electric wire is subjected to such a heating treatment, there is concern that the electrical insulating layer provided on the outer periphery of the constituent conductor of that insulated electric wire may be deteriorated by the heating. Further, when the constituent conductor of the insulated electric wire is recrystallized after the above workings of the insulated electric wire, there is also concern that the constituent conductor of the insulated electric wire may be varied in dimensions by being softened. When the variation in the dimensions of the constituent conductor of the insulated electric wire occurs, the dimensions of the coil molded from that insulated electric wire may be varied or the electrical properties of the coil molded from that insulated electric wire may be varied.

For that reason, for the insulated electric wire designed to be used in molding the coil, it is desirable to subject that insulated electric wire to such a heating treatment (heat the insulated electric wire to such a temperature) as to allow no recrystallization of the copper material constituting the constituent conductor of that insulated electric wire, and thereby reduce the resistance value of the conductor of the worked insulated electric wire to on the order of the resistance value of the conductor of the unworked insulated electric wire.

An object of the present invention is to provide a technique for working an insulated electric wire designed to be used in molding a coil, which is designed to reduce the increased resistance value of a constituent conductor of that insulated electric wire in such a manner as to allow no occurrence of a recrystallization of a copper material constituting the constituent conductor of that insulated electric wire.

A first aspect of the present invention provides an insulated electric wire, comprising:

a conductor composed of a copper material; and an electrical insulating layer provided on an outer periphery of the conductor, wherein, for the conductor, in an orientation intensity ratio obtained by X-ray diffraction of a transverse cross section of the conductor, an intensity in a [200] crystal orientation is higher than an intensity in a [111] crystal orientation.

A second aspect of the present invention provides a coil, comprising an insulated electric wire comprising: a conductor composed of a copper material, with an orientation intensity ratio, which is obtained by X-ray diffraction of a transverse cross section of the conductor before working the insulated electric wire, being such that an intensity in a [200] crystal orientation is higher than an intensity in a [111] crystal orientation; and an electrical insulating layer provided on an outer periphery of the conductor.

A third aspect of the present invention provides a method for producing a coil, comprising:

performing a predetermined working on an insulated electric wire including a conductor composed of a copper material, with an orientation intensity ratio, which is obtained by X-ray diffraction of a transverse cross section of the conductor, being such that an intensity in a [200] crystal orientation is higher than an intensity in a [111] crystal orientation, and an electrical insulating layer provided on an outer periphery of the conductor; and heating the worked insulated electric wire in such a manner that no recrystallization of the copper material for the conductor occurs.

Points of the Invention

According to the present invention, in working the insulated electric wire designed to be used in molding the coil, it is possible to reduce the increased resistance value of the constituent conductor of that insulated electric wire in such a manner as to allow no occurrence of a recrystallization of the copper material constituting the constituent conductor of that insulated electric wire.

DETAILED DESCRIPTION OF THE PREFERRED EMBODIMENTS

A lengthy insulated electric wire is molded into a coil by being wound directly around a core of a stator while being subjected to a bend working, or by being made short and subsequently subjected to a working such as a bend working or a torsion working or the like into segment coils. At this point of time, a working strain is caused in a constituent conductor of that insulated electric wire by the above workings, therefore leading to an increase in resistance value of that conductor. In order to reduce the increased resistance value of the constituent conductor of the insulated electric wire resulting from the above workings, it is necessary to subject the worked insulated electric wire to a heating treatment. A conventional heating treatment requires that insulated electric wire to be heated to such an extent (e.g., to such a temperature higher than 200 degrees C.) as to cause a recrystallization of a copper material (e.g., a copper wire made of an oxygen-free copper) constituting the constituent conductor of that insulated electric wire.

According to a study made by the present inventors, however, it has been found out that when the copper material constituting the constituent conductor of that insulated electric wire has a specific orientation intensity ratio, the resistance value of that conductor measured after the above workings is reduced to on the order of the resistance value of that conductor measured before the above workings by the heating treatment at a temperature at which no recrystallization of the copper material for that conductor occurs. That is, in the present invention, it has been found out that when the conductor composed of the copper material having such a specific orientation intensity ratio is worked, the increased resistance value of that conductor resulting from being worked can be reduced to on the order of the resistance value of that conductor measured before being worked, by heating that conductor at a temperature at which no recrystallization of the copper material for that conductor occurs. The insulated electric wire having the above conductor makes it possible to prevent the occurrence of a variation in the dimensions of that conductor due to the softening of that conductor while preventing the deterioration of the constituent electrical insulating layer of the insulated electric wire after being worked. The present invention has been made, based on the above findings.

One Embodiment

Figure 1:
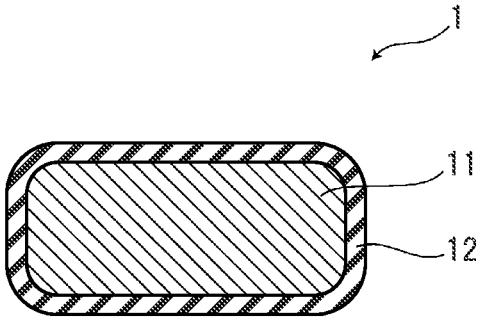
FIG. 1 is a cross-sectional view perpendicular to a longitudinal direction of an insulated electric wire according to one embodiment of the present invention.
Figure 2A:
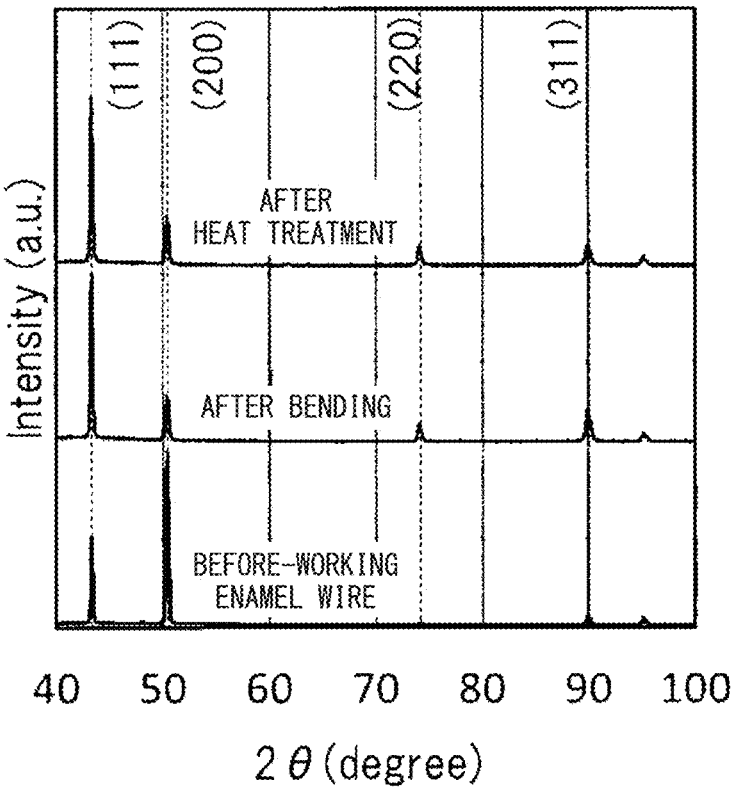
FIG. 2A is an XRD chart obtained by measuring an XRD of a transverse cross section of a conductor according to one embodiment of the present invention.
Figure 2B:
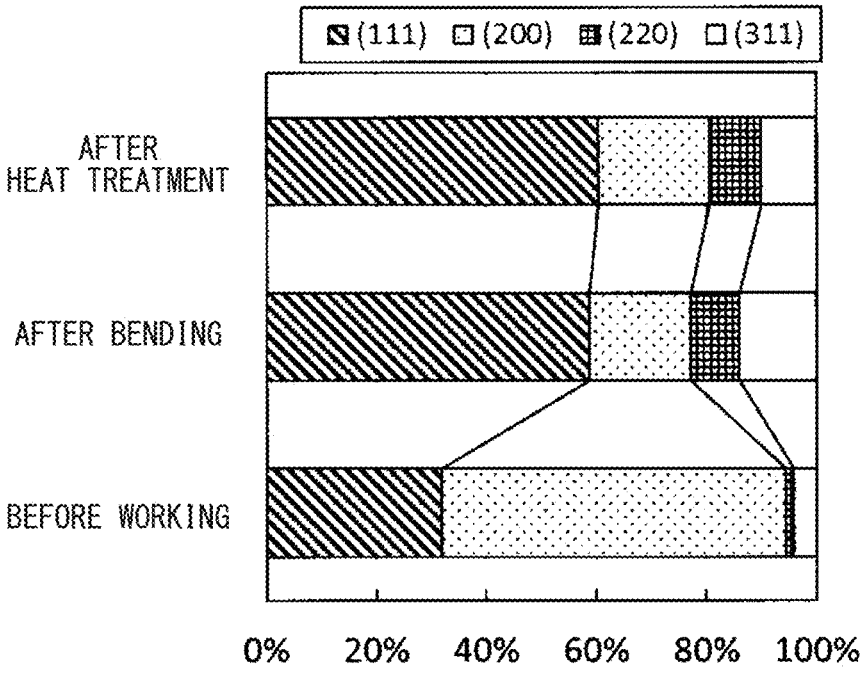
FIG. 2B is a diagram showing an orientation intensity ratio computed from the XRD chart of FIG. 2A.
Figure 3A:
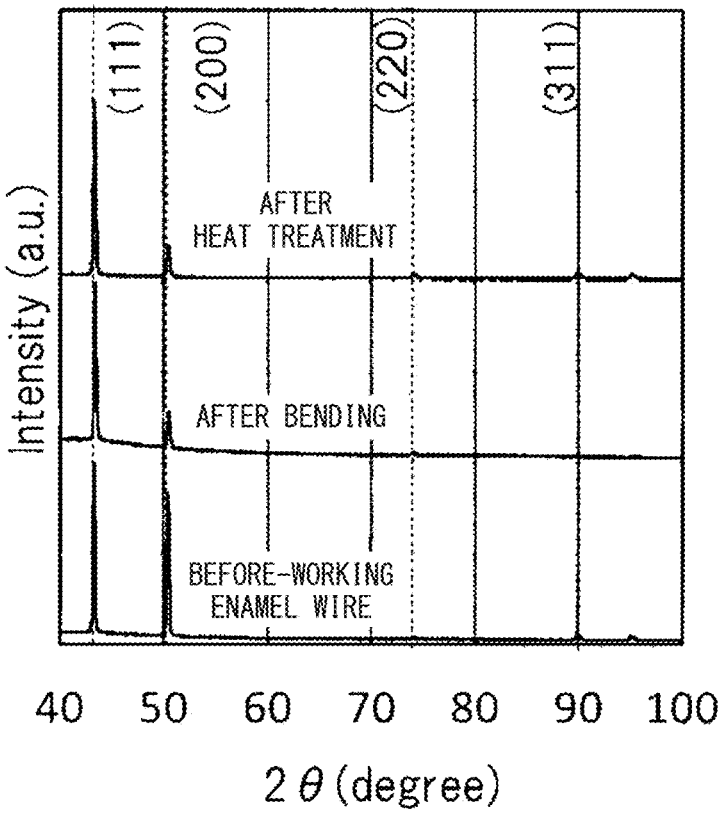
FIG. 3A is an XRD chart obtained by measuring an XRD of a transverse cross section of a conventional conductor.
Figure 3B:
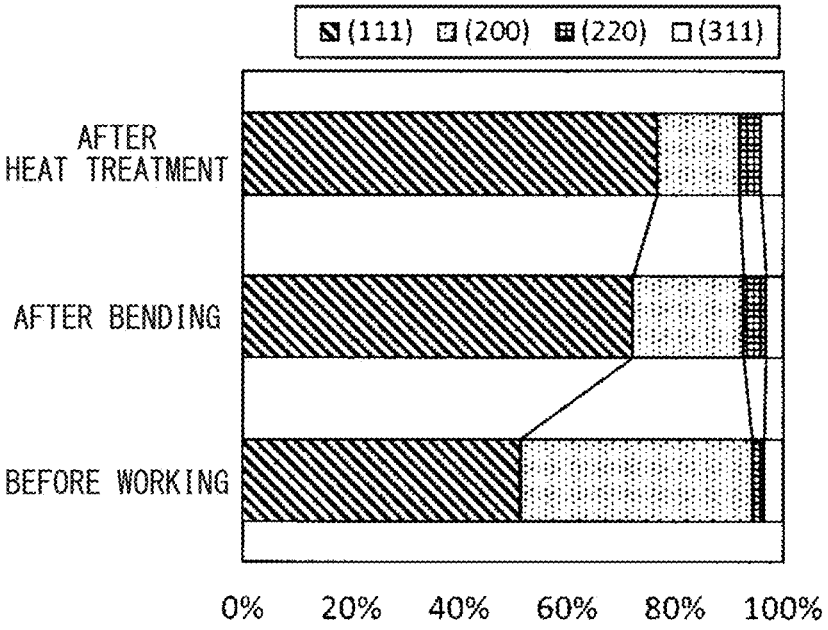
FIG. 3B is a diagram showing an orientation intensity ratio computed from the XRD chart of FIG. 3A.

An insulated electric wire according to one embodiment of the present invention will be described below in conjunction with the accompanying drawings. FIG. 1 is a cross-sectional view perpendicular to a longitudinal direction of an insulated electric wire according to one embodiment of the present invention. FIG. 2A is an XRD chart obtained by measuring an XRD of a transverse cross section of a conductor according to one embodiment of the present invention, and FIG. 2B is a diagram showing an orientation intensity ratio computed from the XRD chart shown in FIG. 2A. FIG. 3A is an XRD chart obtained by measuring an XRD of a transverse cross section of a conventional conductor, and FIG. 3B is a diagram showing an orientation intensity ratio computed from the XRD chart shown in FIG. 3A. Note that herein, numerical value ranges represented by using "to" mean the ranges including numerical values mentioned before and after "to" as a lower limit value and an upper limit value, respectively.

(Insulated Electric Wire)

As shown in FIG. 1, the insulated electric wire (enamel wire) 1 of the present embodiment is the one designed to be used in molding a coil by being subjected to various workings such as an edgewise bend working, a torsion working and the like, for example, and is configured to include a conductor 11, and an electrical insulating layer 12, which is being provided on an outer periphery of that conductor 11.

The constituent conductor 11 of the insulated electric wire (enamel wire) 1 is composed of a copper material. For the conductor 11 of the present embodiment, as shown in FIG. 2B, in an orientation intensity ratio computed by measuring an XRD (X-Ray Diffraction) of a transverse cross section of the conductor 11 prior to the above workings, an intensity in a [200] crystal orientation is higher than an intensity in a [111] crystal orientation. For example, the intensity in the [200] crystal orientation is higher than 1 time and not higher than 2 times the intensity in the [111] crystal orientation.

Herein, the orientation intensity ratio computed by measuring an XRD of a transverse cross section of the conductor refers to the one obtained by performing 2θ-θ X-ray diffraction measurement at diffraction angles of 40 degrees to 100 degrees to measure peak intensities in [111], [200], [220], and [311] copper crystal orientations observed between the diffraction angles of 40 degrees to 100 degrees, and computing a proportion of a peak intensity value in each of those copper crystal orientations to a total value of the peak intensities in those copper crystal orientations, and the orientation intensity ratio computed by measuring the XRD of the transverse cross section of the conductor is represented by the following equation:

$$\text{Orientation intensity ratio (\%)} = I[hkl]/(I[111]+I[200]+I[220]+I[311])$$

By configuring the insulated electric wire 1 to include therein the conductor 11 having the above-described orientation intensity ratio, when the above workings of the insulated electric wire 1 are followed by heating the conductor 11 at a temperature (of, e.g., 80 degrees C. to 100 degrees C.) at which no recrystallization of the copper material for that conductor 11 occurs, the orientation intensity ratio of the conductor 11 (that is, the proportions of the peak intensity values in the [111], [200], [220] and [311] crystal orientations of the conductor 11) can be set at the orientation intensity ratio as shown in FIG. 2B. At this point of time, the orientation intensity ratio of the conductor 11 is substantially equal to the orientation intensity ratio of a bulk copper (a strain-free copper subjected to no working and the like). Since that conductor 11 has the orientation intensity ratio as shown in FIGS. 2A and 2B resulting from the heating of the insulated electric wire 1, the increased resistance value of that conductor 11 resulting from the above workings of the insulated electric wire 1 is considered to be able to be reduced to on the order of the resistance value of that conductor 11 measured before the above workings of the insulated electric wire 1.

From the point of view of making it easy for that conductor 11 to develop the above-described action and effect when heating that conductor 11, it is desirable that, as shown in FIG. 2B, after the above workings of the insulated electric wire 1, its conductor 11 is configured to have the orientation intensity ratio in which the intensity in the [200] crystal orientation becomes lower than the intensity in the [111] crystal orientation, while the intensities in the [220] crystal orientation and the [311] crystal orientation both become higher than the intensities therein measured before the above workings of the insulated electric wire 1. At this point of time, it is more desirable that the intensities in the [220] crystal orientation and the [311] crystal orientation are lower than the intensity in the [200] crystal orientation.

Note that FIG. 3B shows, as a conventional example, an orientation intensity ratio computed by measuring an XRD of a transverse cross section of a conductor in an insulated electric wire in which that conductor is composed of a copper material made of an oxygen-free copper, while an electrical insulating layer is being provided on an outer periphery of that conductor. As shown in FIG. 3B, in the orientation intensity ratio before the above workings of the insulated electric wire, when the orientation intensity ratio is such that the intensity in the [200] crystal orientation is lower than the intensity in the [111] crystal orientation, the effect of reducing the resistance value of the conductor of the worked insulated electric wire is obtained by heating that conductor of the worked insulated electric wire at a temperature at which a recrystallization of the copper material for that conductor occurs. However, when that conductor of the worked insulated electric wire is heated at a temperature at which no recrystallization of the copper material for that conductor occurs, it is difficult for that conductor of the worked insulated electric wire to develop the above-described action, and therefore no effect of reducing the increased resistance value of that conductor resulting from the working of the insulated electric wire to on the order of the resistance value of that conductor measured before the working of the insulated electric wire is produced.

Herein, the heating of the conductor 11 at a temperature at which no recrystallization of the copper material for that conductor 11 occurs means that, when the above workings of the insulated electric wire 1 are followed by heating the conductor 11 in desired conditions, the heating is performed with substantially no variation in the hardness of the copper material constituting the conductor 11 before and after the heating. Specifically, the conductor 11 is heated in such a manner that the hardness of the copper material after the heating is 95% to 100% of the hardness of the copper material before the heating. For example, when the hardness of the copper material before the heating is 100 HV in Vickers hardness, the conductor 11 is heated in desired conditions (e.g., at a heating temperature of 80 degrees C. to 100 degrees C. and for a heating time of 30 minutes to 60 minutes) in such a manner that the hardness of the copper material after the heating is 95 HV to 100 HV in Vickers hardness. At this point of time, no recrystallized grain is produced in the copper material after the heating. The measurement of the Vickers hardness is performed by using a commercially available Vickers hardness tester (e.g., HM-220 available from Mitutoyo Co., Ltd.), and by a testing method described in JIS Z 2244:2009, and the Vickers hardness is obtained by indenting the surface or cross section of the copper material with a diamond indenter in predetermined conditions (e.g., indentation with a load of 200 gf for 15 seconds and removal of the load for 4 seconds), and measuring the size of the indentation.

It is preferable that the copper material to form the conductor 11 includes an additive element selected from the group consisting of Ti, Mg, Zr, Nb, Ca, V, Ni, Mn, and Cr, with the balance of the copper material consisting of copper and inevitable impurities (e.g., sulfur, oxygen, silver and the like). From the point of view of setting the orientation intensity ratio computed by measuring the XRD of the transverse cross section of the conductor at the orientation intensity ratio as shown in FIG. 2B, it is preferable that the concentration of the above-mentioned additive elements is 4 to 55 mass ppm, with the concentration of the inevitable impurity S being 2 to 12 mass ppm, the concentration of the inevitable impurity O being 2 to 30 mass ppm, and the balance of the copper material consisting of copper and other inevitable impurities. When the conductor 11 is composed of the copper material having the above composition, the conductor 11 having the above-described orientation intensity ratio can be produced, therefore it is possible to heat the conductor 11 at a temperature (of, e.g., 80 degrees C. to 100 degrees C.) at which the copper material constituting that conductor 11 is not recrystallized after the above workings of the insulated electric wire 1, and thereby reduce the increased resistance value of the conductor 11 resulting from the above workings to on the order of the resistance value of the conductor 11 measured before the working of the insulated electric wire 1 into a coil shape. Note that when the additive elements described above are the Ti, the above-described action and effect are easily obtained.

Further, it is more preferable that the copper material constituting the conductor 11 has a chemical composition in which the ratio of the concentration of the additive elements to the oxygen concentration is 2.0 to 4.0. In the copper material to constitute the conductor 11, by making the concentrations of the sulfur (S) and the oxygen (O) low while compounding a high amount of the above-mentioned additive elements such as the titanium (Ti) or the like to adjust the ratio of the concentration of the additive elements to the O concentration to the predetermined range, the above-mentioned orientation intensity ratio is easily obtained. The reason for this is assumed to be because when the copper material to constitute the conductor 11 is produced by casting, the purity of the matrix (Cu) can be enhanced by the compound of the additive elements and the S being formed as a precipitate.

In addition, from the point of view of making the conductivity of the conductor 11 high, the copper material constituting the conductor 11 preferably has a concentration of the above-mentioned additive elements of not higher than 37 mass ppm, and more preferably not higher than 25 mass ppm. In addition, for the copper material according to the present embodiment, it is preferable to set the O concentration at 5 to 15 mass ppm, from the point of view of reducing the increased resistance value of the conductor 11 resulting from the working to on the order of the resistance value of the conductor 11 measured before the working, when heating the conductor 11 at a temperature (of, e.g., 80 degrees C. to 100 degrees C.) at which no recrystallization of the copper material for that conductor 11 occurs. Further, the ratio of the concentration of the additive elements to the O concentration is more preferably 2.0 to 3.0. With the copper material having the above composition, it is possible to prevent the recrystallization of the copper material from being easily developed when the conductor 11 of the worked insulated electric wire is heated.

In the copper material constituting the conductor 11, the compounds including the additive elements as the precipitates are being finely dispersed and distributed. When the sizes (particle sizes) of these precipitates are, e.g., 20 nm to 300 nm, since the precipitates can be finely dispersed in the conductor 11, the above-mentioned orientation intensity ratio is assumed to be easily obtained. Note that the compounds including the additive elements that are the precipitates can be identified by mirror polishing and etching the transverse cross section of the copper material and observing it with an electron microscope (SEM), and the dispersed state and the particle sizes of the compounds can also be measured.

Note that, as will be described later, the S and the O are the inevitable impurity elements derived from the copper raw material, and the additive elements selected from the group consisting of Ti, Mg, Zr, Nb, Ca, V, Ni, Mn, and. Cr are the elements added to the molten copper when the conductor 11 is cast.

The cross-sectional shape of the conductor 11 is not particularly limited to a circular shape or a rectangular shape or the like, but from the point of view of enhancing the stacking factor in the working of the insulated electric wire 1 into a coil, the cross-sectional shape of the conductor 11 is preferably a rectangular shape as shown in FIG. 1. The thickness and width of the conductor 11 may be appropriately altered according to the use applications of the insulated electric wire 1, and e.g., the thickness of the conductor 11 may be set at 0.5 mm to 10 mm while the width of the conductor 11 may be 1 mm to 25 mm.

The electrical insulating layer 12 is being provided on the outer periphery of the conductor 11. As a resin to form the electrical insulating layer 12, e.g., at least one thermosetting resin of a polyimide resin, a polyamide imide resin, and a polyester imide resin can be used. Note that the electrical insulating layer 12 is formed by applying an electrical insulating coating material including the above-mentioned thermosetting resin to the outer periphery of the conductor 11 and subsequent baking. Further, the thickness of the electrical insulating layer 12 may be appropriately altered according to the electrical properties required for the coil. The electrical insulating layer 12 may be configured with a polyimide resin, a polyamide imide resin, or a polyester imide resin, being made low in imide group concentration (being, e.g., lower than 36% in imide group concentration), but being high in partial discharge inception voltage (being, e.g., not lower than 1000 Vp in peak voltage). Further, the electrical insulating layer 12 may be porous in order to make its dielectric constant low. Further, the electrical insulating layer 12 may be configured with a resin including inorganic fine particles of silica or alumina or the like, and being made high in resistance to partial discharge (partial discharge resistance). Further, the resin to constitute the electrical insulating layer 12 may be configured with a resin made of a thermoplastic resin such as a PEEK (polyether ether ketone) resin or a PPS (polyphenylene sulfide) resin or the like.

Note that, although in the insulated electric wire 1 shown in FIG. 1, the electrical insulating layer 12 is being provided in one layer on the outer periphery of the conductor 11, the present invention is not limited to this, but that, the electrical insulating layer 12 with the layer composed of the above described resin being stacked in two or more layers therein may be provided on the outer periphery of the conductor 11.

(Insulated Electric Wire Producing Method)

Next, a method of producing the above-described insulated electric wire 1 will be described.

Specifically, a melt is prepared by adding the above-described additive elements to a molten copper obtained by heating and melting a Cu raw material. At this point of time, in the chemical composition of the melt, the concentration of the additive elements is 4 to 55 mass ppm, the inevitable impurity S concentration is 2 to 12 mass ppm, the inevitable impurity O concentration is 2 to 30 mass ppm, and the balance of the copper material consists of Cu and other inevitable impurities. Preferably, each of the raw materials is selected and mixed in such a manner that the ratio of the concentration of the additive elements to the O concentration is 2.0 to 4.0 within the above-mentioned chemical composition ranges.

The reason for adding the additive elements is because the additive elements are reacted with the inevitable impurity S or O in the melt. For example, when the Ti is added as the additive elements, the Ti reacts with the S or the O to form Ti compounds such as TiO, $TiO_2$, TiS, Ti—O—S particles and the like as the precipitates. The formation of the precipitates allows the S or the O contained in the matrix (Cu) to be reduced, thereby being able to make the purity of the matrix (Cu) high. Further, the reason for setting the ratio of the concentration of the additive elements to the O concentration at 2.0 to 4.0 is because the adding of the excessive amount of the additive elements to the O allows the additive elements to sufficiently react with the O while allowing the additive elements to form solid solutions and facilitate the precipitation with the S in a hot rolling step, which will be described later.

Note that the melt may be placed under a reductive gas atmosphere such as a carbon monoxide or the like, for example, to suppress O from outside from being mixed into the melt. This facilitates controlling the O concentration within a predetermined range.

Next, the melt is cast to form a cast material. In the cast material, the additive elements and the S or the O form the precipitates, while the unreacted additive elements and the unreacted S form the solid solutions in the matrix. Note that, in forming the cast material, the cast material may be formed by continuous casting.

Next, the cast material is subjected to a hot rolling working, and the surface of the rolled material resulting from the hot rolling is subjected to a cleaning treatment by an oxidation-reduction reaction, to thereby form a wire rod. For example, in the hot rolling working, the cross-sectional area of the cast material may be reduced stepwise by hot rolling the cast material multiple times using a rolling mill having a plurality of mill rolls. The temperature at the time of hot rolling (the hot rolling temperature) may be lowered stepwise from the upstream mill roll to the downstream mill roll in the plurality of mill rolls. For example, the hot rolling working may be composed of an upstream rough rolling working and a downstream finish rolling working, and the hot rolling temperature may be gradually lowered in the range of 500 degrees C. to 880 degrees C. to perform the rolling working stepwise multiple times. In the present embodiment, the rolled material is produced by hot rolling working the cast material in the above described manner. Note that, since the ductility of the cast material can be made high by adjusting the additive elements such as the Ti or the like, and the S and the O to have the above composition while adjusting the ratio of the concentration of the additive elements to the oxygen concentration to be the predetermined ratio in the cast material, the rolling working can be performed lowering the hot rolling temperature.

In particular, in the present embodiment, it is preferable that the above-mentioned cast material to be subjected to the hot rolling working stepwise is subjected to the hot rolling working in which the hot rolling temperature in the final mill roll is in the range of 500 degrees C. to 550 degrees C. Further, in the present embodiment, when the hot rolling working is performed in the plurality of mill rolls, the time (the hot rolling time) taken from the hot rolling working in the primary (first) mill roll until the hot rolling working in the final mill roll is preferably not shorter than 10 seconds. Carrying out the hot rolling working in the foregoing conditions allows the unreacted additive elements and the unreacted S forming the solid solutions in the Cu phase in the melt to react and thereby precipitate. As a result, it is possible to further enhance the purity of the matrix in the resulting wire rod. Note that the outer diameter of the wire rod is not particularly limited, but may be 6 mm to 20 mm, for example.

Next, the wire rod is subjected to, for example, a cold wire drawing working and a heating treatment, to thereby form the wire rod being of a rectangular shape in cross section. The wire rod may be set at e.g. 0.5 mm to 10 mm in thickness and 1 mm to 25 mm in width.

Next, the electrical insulating coating material including the above-mentioned thermosetting resin, for example, is applied to the outer periphery of the wire rod formed as the conductor 11 which will be described later, and the applied electrical insulating coating material is baked (the thermosetting resin is cured) to thereby form the electrical insulating layer 12 on the outer periphery of the wire rod. For example, the application and baking of the electrical insulating coating material may be repeated until the electrical insulating layer 12 has a desired thickness. Note that when baking the electrical insulating coating material, the electrical insulating layer 12 may be formed, for example, by irradiating the wire rod with the electrical insulating coating material applied thereto with near infrared rays to thereby evaporate only the solvent contained in the electrical insulating coating material, and subsequently cure the thermosetting resin contained in the electrical insulating coating material.

This results in the insulated electric wire 1 of the present embodiment described above, that is, the insulated electric wire (enamel wire) 1 having therein the electrical insulating layer 12 on the outer periphery of the conductor 11 composed of the copper material, wherein, for the conductor 11, in the orientation intensity ratio computed by measuring the XRD of the transverse cross section of the conductor 11 before the insulated electric wire 1 is worked, the intensity in the [200] crystal orientation is higher than the intensity in the [111] crystal orientation.

(Coil and Producing Method Therefor)

Next, a coil using the insulated electric wire 1 described above and a method for producing that coil will be described.

First, the insulated electric wire 1 described above is wound around to be molded into a coil. For example, the insulated electric wire 1 is subjected to an edgewise bend working by bending in its width directions (left and right directions of the page in FIG. 1), to thereby form the insulated electric wire 1 into a coil shape. Terminal portions of a plurality of the coil shaped insulated electric wires 1 are connected together, to thereby mold a coil. When the insulated electric wire 1 is worked, the working strain is accumulated in the conductor 11 of the insulated electric wire 1, and the resistance value of the conductor 11 is increased by on the order of 10% at maximum compared to before the working. Note that, besides being wound around to be molded into a coil as described above, the insulated electric wire 1 may be molded into a coil by being cut to a desired length, and the cut short insulated electric wires 1 being subjected to a working such as a bend working or a torsion working or the like into segment coils. In this case, terminal portions of a plurality of the segment coils are connected together by welding such as TIG welding or the like, to thereby mold a coil.

Next, in order to reduce the resistance value of the conductor 11 after the working of the insulated electric wire 1, the insulated electric wire 1 after the working is heated in such a manner that no recrystallization of the copper material constituting the conductor 11 occurs. In the insulated electric wire 1 according to the present embodiment, since, in the orientation intensity ratio computed by measuring the XRD of the transverse cross section of the conductor 11 before the working of the insulated electric wire 1, the intensity in the [200] crystal orientation is higher than the intensity in the [111] crystal orientation, by heating the insulated electric wire 1 at a temperature at which no recrystallization of the copper material constituting the conductor 11 occurs, the increased resistance value of the conductor 11 can be reduced to on the order of the resistance value of the conductor 11 measured before the working.

Note that the heating time for the insulated electric wire 1 may be decreased in such a manner that the resistance value of the conductor 11 measured after the heating is in a range of an increase within 1% of the resistance value of the conductor 11 measured before the working, and that the heating time for the insulated electric wire 1 may be set appropriately. For example, the heating time for the insulated electric wire 1 may be set at not shorter than 0.5 hours (30 minutes) and not longer than 1 hour (60 minutes). Note that the heating of the worked insulated electric wires 1 may be performed before or after the connecting together of the terminal portions of the plurality of the worked insulated electric wires 1. For example, the heating of the worked insulated electric wires 1 can performed by connecting the respective terminal portions of the worked plurality of insulated electric wires 1 together to mold a coil, and subsequently utilizing the heat in a varnishing treatment applied to the surface of the coil.

This results in the coil of the present embodiment.

Note that, although in the present embodiment, a case in which the insulated electric wire 1 is the rectangular wire having therein the conductor 11 being of a rectangular shape in transverse cross section has been described, the present invention is not limited to this, but that the insulated electric wire 1 may be of a round linear shape with the conductor 11 being of a round shape in transverse cross section. Further, examples of the workings in performing the predetermined working on the insulated electric wire 1 include a bend working, a torsion working, a crushing working, a wire drawing working and the like. Even when the insulated electric wire 1 is subjected to a working other than the above workings, the resistance value of the conductor 11 measured after that working can be reduced to on the order of the resistance value of the conductor 11 measured before that working by heating at a temperature at which no recrystallization of the conductor 11 occurs.

Advantageous Effects of the Present Embodiment

The present embodiment has one or more of the following advantageous effects.

In the insulated electric wire 1 of the present embodiment, in the orientation intensity ratio computed by measuring the XRD of the transverse cross section of the conductor 11 before the working of the insulated electric wire 1, the intensity in the [200] crystal orientation is higher than the intensity in the [111] crystal orientation. With the insulated electric wire 1, by heating the insulated electric wire 1 at a temperature at which no recrystallization of the copper material constituting the conductor 11 occurs, the increased resistance value of the conductor 11 resulting from the above working can be reduced to on the order of the resistance value of the conductor 11 measured before the working. As a result, in the insulated electric wire 1 of the present embodiment, it is possible to prevent the occurrence of a variation in the dimensions of the conductor 11 or the coil due to the softening of the conductor 11 after the above working.

It is preferable that the copper material constituting the conductor 11 has the chemical composition in which the concentration of the additive elements is 4 to 55 mass ppm, the inevitable impurity S concentration is 2 to 12 mass ppm, the inevitable impurity O concentration is 2 to 30 mass ppm, and the balance of the copper material consists of Cu and other inevitable impurities, with the ratio of the Ti concentration to the O concentration being 2.0 to 4.0. In the above copper material, since the purity of the Cu can be made high by the precipitation between the additive elements and the S or the O, it is easy to produce the conductor 11 having the above-mentioned orientation intensity ratio.

Further, it is preferable that the copper material constituting the conductor 11 has the compounds including the additive elements as the precipitates, and that the particle sizes of the compounds including the additive elements are 20 nm to 300 nm. The compounds including the additive elements are finely dispersed in the conductor 11 with small particle sizes as described above, and therefore when the conductor 11 is heated, the metal crystal structure constituting the conductor 11 can be finely maintained. This allows the elongation rate of the conductor 11 to be high.

Further, in the present embodiment, it is preferable that when the cast material is subjected to the hot rolling working multiple times to produce the wire rod, the temperature at which the hot rolling working is performed in the final mill roll is set at 500 degrees C. to 550 degrees C. Further, when the hot rolling working is performed in the plurality of mill rolls, the time (the hot rolling time) taken from the hot rolling working in the primary (first) mill roll until the hot rolling working in the final mill roll is preferably not shorter than 10 seconds. Carrying out the hot rolling working in the foregoing conditions allows the additive elements and the S forming the solid solutions in the Cu phase in the cast material to further precipitate. As a result, the resulting insulated electric wire 1 can have the conductor 11 in which, in the orientation intensity ratio computed by measuring the XRD of the transverse cross section before the working of the insulated electric wire 1, the intensity in the [200] crystal orientation is higher than the intensity in the [111] crystal orientation.

The coil of the present embodiment is molded by the working of the insulated electric wire 1 having the conductor 11 in which, in the orientation intensity ratio computed by measuring the XRD of the transverse cross section before the working of the insulated electric wire 1, the intensity in the [200] crystal orientation is higher than the intensity in the [111] crystal orientation, and the electrical insulating layer 12 is being formed of at least one thermosetting resin of a polyimide resin, a polyamide imide resin, and a polyester imide resin. In the conductor 11, since in the orientation intensity ratio computed by measuring the XRD of the transverse cross section before the working of the insulated electric wire 1, the intensity in the [200] crystal orientation is higher than the intensity in the [111] crystal orientation, even when the insulated electric wire 1 is heated at a temperature at which no recrystallization of the conductor 11 occurs, the resistance value of the conductor 11 can be reduced to the same level as the resistance value of the conductor 11 measured before the working of the insulated electric wire 1, and high electrical properties can be maintained in the coil with no occurrence of a variation in the dimensions of the conductor 11 or the coil due to the softening of the conductor 11.

EXAMPLES

Next, the present invention will be described in more detail based on examples, but the present invention is not limited to these examples. In the present examples, insulated electric wires were produced, and the resistance values of their conductors were measured before and after working the insulated electric wires.

Example 1

First, a conductor formed of a copper material was produced. Specifically, by preparing a predetermined Cu raw material and a predetermined Ti raw material and mixing, heating and melting them, as shown in Table 1, a melt was prepared that had a chemical composition such that the Ti concentration was 30 mass ppm, and the balance of the copper material consisted of Cu and an inevitable impurity S whose concentration was 4 mass ppm and an inevitable impurity O whose concentration was 15 mass ppm, and the ratio of the Ti concentration to the O concentration was 2.0. Subsequently, the melt was cast to form a cast material, and the cast material was subjected to the hot rolling working, and the surface of the rolled material after the hot rolling working was subjected to a cleaning treatment by a redox reaction. This resulted in a wire rod having an outer diameter of 8 mm. In the hot rolling working, the temperature in the first mill roll was set at 850 degrees C., the temperature in the final mill roll was set at 500 degrees C., and the time (the hot rolling time) taken from the hot rolling working in the first mill roll until the hot rolling working in the final mill roll was set at 15 seconds. Next, the wire rod was subjected to the cold wire drawing working, the cold rolling working, and if desired, the heat treatment. This resulted in a rectangular shape conductor having a width of 3.4 mm and a thickness of 2.0 mm. Note that, as a result of observation of the cross section of the conductor with an electron microscope, it was observed that the Ti compounds as the precipitates were being finely dispersed, and that the particle sizes of the Ti compounds were on the order of 100 nm.

Subsequently, an electrical insulating layer was formed on the outer periphery of the conductor by applying an electrical insulating coating material including a thermosetting resin made of a polyimide and subsequent baking. This resulted in an insulated electric wire of Example 1. Note that, in the produced insulated electric wire of Example 1, as a result of computing the orientation intensity ratio from the XRD chart obtained by measuring the XRD of the transverse cross section of the conductor using the above-described XRD measurement method, the insulated electric wire of Example 1 had a similar orientation intensity ratio to the orientation intensity ratio shown in FIG. 2B.

Figure 4:
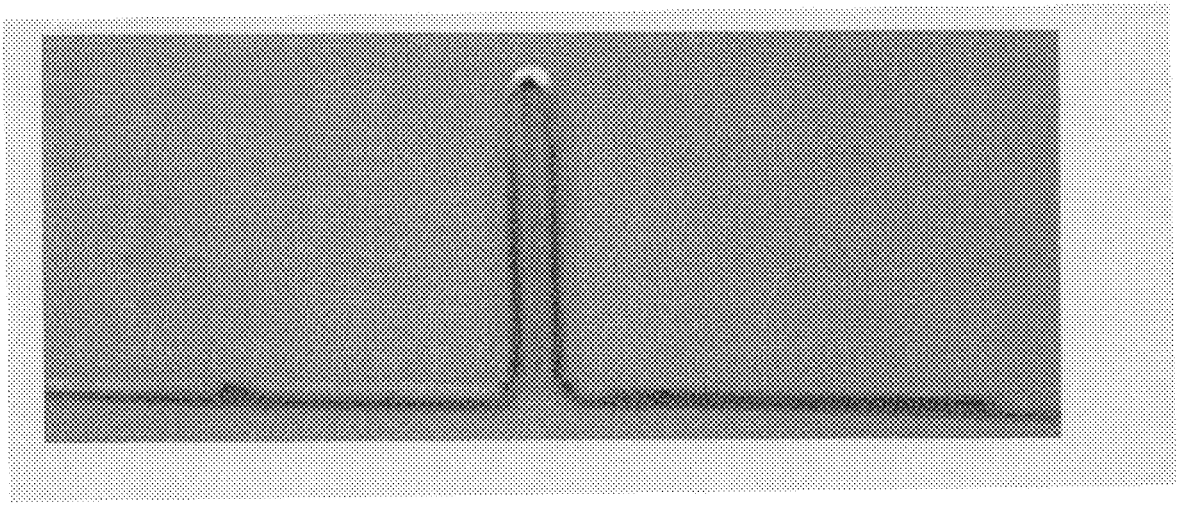
FIG. 4 is a diagram showing an insulated electric wire subjected to an edgewise bend working.

The resistance value of the conductor at the time of producing the insulated electric wire was measured by the 4-terminal method, and was computed as the initial resistance value. Subsequently, as shown in FIG. 4, the produced insulated electric wire was subjected to the edgewise bend working of 90 degrees, 180 degrees, and 90 degrees in the width direction with respect to three desired places in the longitudinal direction of the insulated electric wire, and the resistance value of the conductor at the time of the bend working was measured by the 4-terminal method. After that, the heating treatment of the insulated electric wire was performed in the constant temperature bath while keeping the shape of the insulated electric wire but changing the temperature and the time. The resistance value of the conductor after the heating treatment was measured by the 4-terminal method, and the change in the resistance value with respect to the initial resistance value was computed.

Examples 2 and 3, Comparative Examples 1 to 3

In Examples 2 and 3, insulated electric wires were produced in the same manner as in Example 1 except that the heating treatment conditions were appropriately altered as shown in Table 1, and the measurement of the resistance values of the conductors was performed in the same mariner as in Example 1. In Comparative Examples 1 to 3, insulated electric wires were produced in the same manner as in Example 1 except that materials therefor having different compositions of cast materials were used and that the producing method was altered from the hot rolling working to hot extrusion, and the measurement of the resistance values of the conductors was performed in the same as in Example 1.

Note that, in the produced insulated electric wires of Examples 2 and 3, as a result of computing the orientation intensity ratios from the XRD charts obtained by measuring the XRDs of the transverse cross sections of the conductors using the same method as in Example 1, the insulated electric wires of Examples 2 and 3 had similar orientation intensity ratios to the orientation intensity ratio shown in FIG. 2B. Also, in the produced insulated electric wires of Comparative Examples 1 to 3, as a result of computing the orientation intensity ratios from the XRD charts obtained by measuring the XRDs of the transverse cross sections of the conductors, the produced insulated electric wires of Comparative Examples 1 to 3 had similar orientation intensity ratios to the orientation intensity ratio shown in FIG. 3B.

TABLE 1

| | | Example 1 | Example 2 | Example 3 | Comparative example 1 | Comparative example 2 | Comparative example 3 |
|---|---|---|---|---|---|---|---|
| Composition (ppm) | Ti | 30 | 30 | 30 | <1 | <1 | <1 |
| | O | 15 | 15 | 15 | 3 | 3 | 3 |
| | S | 4 | 4 | 4 | 4 | 4 | 4 |
| Heating treatment temperature (° C.) | | 100 | 100 | 100 | 100 | 200 | 240 |
| Heating treatment time (min) | | 60 | 30 | 20 | 60 | 60 | 60 |
| Evaluation | | ◎ | ◎ | ○ | X | X | ○ |

(Evaluation)

If the difference between the resistance value after the working/heating treatment and the resistance value (the initial resistance value) before the working of the insulated electric wire was not more than 0.5%, that insulated electric wire was evaluated as ◎, or if that difference therebetween was more than 0.5% and not more than 1.0%, that insulated electric wire was evaluated as ○, or if that difference therebetween did not meet those (more than 1.0%), that insulated electric wire was evaluated as X.

(Evaluation Results)

As a result of measuring the resistance values of the insulated electric wire of Example 1 before and after the working/heating treatment, the resistance values of the insulated electric wire of Example 1 showed substantially the same values, and it was shown that the resistance value thereof after the working/heating treatment was decreased to on the order of the resistance value thereof before the bend working. In addition, in Example 2, the same working as in Example 1 was performed, and it was shown that the resistance value of the insulated electric wire of Example 2 after the working/heating treatment was decreased even when the heating treatment time was changed.

Example 3 was made of the same material as those of Examples 1 and 2, but it was shown that when the heating treatment time was made shorter than that of Example 2, the degree of decreasing in the resistance value became smaller.

Note that, with respect to the insulated electric wires of Examples 1 to 3, as a result of the observation of the cross sections of the conductors with the electron microscope after the bend working, it was confirmed that the copper materials constituting the conductors were not being recrystallized by the heating treatment.

Further, in the insulated electric wires of Comparative Examples 1 to 3, the orientation intensity ratios of the [200] and [111] crystal orientations after the working were high, and remained unchanged even after the heating treatment, so it was assumed that no decreasing behaviors of the resistance values were observed. Note that in Comparative Example 3, a decrease in the resistance value was observed so the evaluation was ○, but that a thermal deterioration was observed in the electrical insulating layer. Note that, for the insulated electric wires of Comparative Examples 1 to 3, as a result of the observation of the cross sections of the conductors after the bend working with the electron microscope, it was observed that the copper materials constituting the conductors of Comparative Examples 1 and 2 were not being recrystallized by the heating treatment, but that it was observed that the copper material constituting the conductor of Comparative Example 3 was being recrystallized by the heating treatment.

Preferred Aspects of the Present Invention

Hereinafter, preferred aspects of the present invention will be described as supplementary description.

[Supplementary Description 1]

One aspect of the present invention provides an insulated electric wire, comprising:

a conductor composed of a copper material; and an electrical insulating layer provided on an outer periphery of the conductor, wherein, for the conductor, in an orientation intensity ratio obtained by X-ray diffraction of a transverse cross section of the conductor, an intensity in a [200] crystal orientation is higher than an intensity in a [111] crystal orientation.

[Supplementary Description 2]

In the insulated electric wire as defined in Supplementary description 1, preferably, the copper material for the conductor includes an additive elements selected from the group consisting of Ti, Mg, Zr, Nb, Ca, V, Ni, Mn, and Cr, and the balance consists of copper and inevitable impurities.

[Supplementary Description 3]

In the insulated electric wire as defined in Supplementary description 2, preferably, the electrical insulating layer is composed of at least one thermosetting resin of a polyimide resin, a polyamide imide resin and a polyester imide resin.

[Supplementary Description 4]

Another aspect of the present invention provides a coil, comprising an insulated electric wire comprising: a conductor composed of a copper material, with an orientation intensity ratio, which is obtained by X-ray diffraction of a transverse cross section of the conductor before working the insulated electric wire, being such that an intensity in a [200] crystal orientation is higher than an intensity in a [111] crystal orientation; and an electrical insulating layer provided on an outer periphery of the conductor.

[Supplementary Description 5]

Still another aspect of the present invention provides a method for producing a coil, comprising:

performing a predetermined working on an insulated electric wire including a conductor composed of a copper material, with an orientation intensity ratio, which is obtained by X-ray diffraction of a transverse cross section of the conductor, being such that an intensity in a [200] crystal orientation is higher than an intensity in a [111] crystal orientation, and an electrical insulating layer provided on an outer periphery of the conductor; and heating the worked insulated electric wire in such a manner that no recrystallization of the copper material for the conductor occurs.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An insulated electric wire, comprising:

a conductor composed of a copper material; and an electrical insulating layer provided on an outer periphery of the conductor, wherein, for the conductor, in an orientation intensity ratio obtained by X-ray diffraction of a transverse cross section of the conductor, an intensity in a [200] crystal orientation is higher than an intensity in a [111] crystal orientation.

2. The insulated electric wire according to claim 1, wherein the copper material for the conductor includes an additive elements selected from the group consisting of Ti, Mg, Zr, Nb, Ca, V, Ni, Mn, and Cr, and the balance consists of copper and inevitable impurities.

3. The insulated electric wire according to claim 1, wherein the electrical insulating layer is composed of at least one thermosetting resin of a polyimide resin, a polyamide imide resin and a polyester imide resin.

4. A coil, comprising:

an insulated electric wire comprising:

a conductor composed of a copper material, with an orientation intensity ratio, which is obtained by X-ray diffraction of a transverse cross section of the conductor before working the insulated electric wire, being such that an intensity in a [200] crystal orientation is higher than an intensity in a [111] crystal orientation; and an electrical insulating layer provided on an outer periphery of the conductor.

5. A method for producing a coil, comprising:

performing a predetermined working on an insulated electric wire including a conductor composed of a copper material, with an orientation intensity ratio, which is obtained by X-ray diffraction of a transverse cross section of the conductor, being such that an intensity in a [200] crystal orientation is higher than an intensity in a [111] crystal orientation, and an electrical insulating layer provided on an outer periphery of the conductor; and heating the worked insulated electric wire in such a manner that no recrystallization of the copper material for the conductor occurs.

* * * * *